US009062665B2

(12) United States Patent
Schedgick et al.

(10) Patent No.: US 9,062,665 B2
(45) **Date of Patent: *Jun. 23, 2015**

(54) HYDRAULIC PISTON PUMP WITH THROTTLE CONTROL

(71) Applicant: HUSCO International, Inc., Waukesha, WI (US)

(72) Inventors: David Schedgick, Menasha, WI (US); Bradley Kramer, Oconomowoc, WI (US); Joe Pfaff, Wauwatosa, WI (US)

(73) Assignee: HUSCO International, Inc., Waukesha, WI (US)

( * ) Notice: Subject to any disclaimer, the term of this patent is extended or adjusted under 35 U.S.C. 154(b) by 233 days.

This patent is subject to a terminal disclaimer.

(21) Appl. No.: 13/741,928

(22) Filed: Jan. 15, 2013

(65) Prior Publication Data

US 2014/0199187 A1 Jul. 17, 2014

(51) Int. Cl.

| | |
|---|---|
| ***F04B 49/22*** | (2006.01) |
| ***F04B 1/053*** | (2006.01) |
| ***F04B 49/03*** | (2006.01) |

(52) U.S. Cl.

CPC ..... *F04B 1/0531* (2013.01); *F04B 1/053* (2013.01); *F04B 49/03* (2013.01)

(58) Field of Classification Search

CPC ..... F04B 1/0531; F04B 49/03; F04B 1/053
USPC ..... 417/269, 270, 440, 213, 295; 91/498; 60/452, 408–410
See application file for complete search history.

(56) References Cited

U.S. PATENT DOCUMENTS

| | | | | |
|---|---|---|---|---|
| 1,694,329 | A | | 12/1928 | Lebus |
| 2,546,583 | A | * | 3/1951 | Born ..... 91/482 |
| 3,151,569 | A | | 10/1964 | Muller |
| 3,418,937 | A | | 12/1968 | Cardillo et al. |
| 3,434,428 | A | * | 3/1969 | Liles ..... 417/270 |
| 4,065,229 | A | * | 12/1977 | Black ..... 417/270 |
| 4,094,617 | A | | 6/1978 | Shibuya |
| 4,490,971 | A | | 1/1985 | Hedelin |
| 4,643,639 | A | | 2/1987 | Caine |
| 5,156,531 | A | | 10/1992 | Schmid et al. |
| 5,167,493 | A | | 12/1992 | Kobari |
| 5,277,553 | A | | 1/1994 | Stolpp |

(Continued)

FOREIGN PATENT DOCUMENTS

JP 09228943 2/1997

OTHER PUBLICATIONS

Notice of Allowance dated Sep. 12, 2014 in commonly owned U.S. Appl. No. 13/343,436.

(Continued)

*Primary Examiner* — Charles Freay
(74) *Attorney, Agent, or Firm* — Andrus Intellectual Property Law, LLP

(57) ABSTRACT

A pump system has a piston pump. The piston pump has a cylinder block with an inlet port, an outlet port, and a plurality of cylinders. Each cylinder in the plurality of cylinders is connected to the inlet port by an inlet passage and to the outlet port by an outlet passage. The piston pump has a plurality of pistons disposed in the plurality of cylinders. A drive shaft drives the pistons within the cylinders. A throttle member independently throttles flow in each inlet passage. The pump system has an electrohydraulic actuator governing movement of the throttle member.

39 Claims, 11 Drawing Sheets

(56) References Cited

U.S. PATENT DOCUMENTS

| | | | | |
|---|---|---|---|---|
| 5,634,777 | A | 6/1997 | Albertin et al. | |
| 5,701,873 | A * | 12/1997 | Schneider | 123/516 |
| 5,810,569 | A | 9/1998 | Buckley et al. | |
| 5,873,706 | A | 2/1999 | Kawabata | |
| 6,213,729 | B1 * | 4/2001 | Fassbender et al. | 417/273 |
| 6,347,516 | B1 * | 2/2002 | Bolz et al. | 60/431 |
| 7,921,878 | B2 | 4/2011 | Coolidge | |
| 8,579,709 | B2 * | 11/2013 | Saffari et al. | 463/42 |
| 8,746,420 | B2 * | 6/2014 | Costaz | 188/170 |
| 8,926,298 | B2 * | 1/2015 | Rajput et al. | 417/532 |
| 2004/0101417 | A1 | 5/2004 | Arai et al. | |
| 2012/0111185 | A1 | 5/2012 | Stephenson et al. | |

OTHER PUBLICATIONS

U.S. Appl. No. 13/343,436, filed Jan. 4, 2012.

International Search Report and Written Opinion issued by the Korean Intellectual Property Office dated Mar. 14, 2014.

* cited by examiner

HYDRAULIC PISTON PUMP WITH THROTTLE CONTROL

FIELD

The present disclosure relates to hydraulic pumps, and more specifically to mechanisms for controlling hydraulic pump systems.

BACKGROUND

U.S. Patent Application Publication No. 2012/0111185, which is hereby incorporated by reference in entirety, discloses a high efficiency diametrically compact, radial oriented piston hydraulic machine. The machine includes a cylinder block with a plurality of cylinders coupled to a first port by first valve and to a second port by a second valve. A drive shaft with an eccentric cam is rotatably received in the cylinder block and a cam bearing extends around the eccentric cam. A separate piston is slideably received in each cylinder. A piston rod is coupled at one end to the piston and a curved shoe at the other end abuts the cam bearing. The curved shoe distributes force from the piston rod onto a relatively large area of the cam bearing and a retaining ring holds each shoe against the cam bearing. The cylinder block has opposing ends with a side surface there between through which every cylinder opens. A band engages the side surface closing the openings of the cylinders.

U.S. patent application Ser. No. 13/343,436, which is hereby incorporated by reference in entirety, discloses a radial piston pump having a plurality of cylinders within which pistons reciprocally move. Each cylinder is connected to a first port by an inlet passage that has an inlet check valve, and is connected to a second port by an outlet passage that has an outlet check valve. A throttling plate extends across the inlet passages and has a separate aperture associated with each inlet passage. Rotation of the throttling plate varies the degree of alignment of each aperture with the associated inlet passage, thereby forming variable orifices for altering displacement of the pump. Uniquely shaped apertures specifically affect the rate at which the variable orifices close with throttle member movement, so that the closure rate decreases with increased closure of the variable orifices.

SUMMARY

This summary is provided to introduce a selection of concepts that are further described below in the detailed description. This summary is not intended to identify key or essential feature of the claimed subject matter, nor is it intended to be used as an aid in limiting the scope of the claimed subject matter.

Pump systems are disclosed. In some examples, the pump system has a piston pump comprising a cylinder block having an inlet port, an outlet port, and a plurality of cylinders disposed therein, each cylinder in the plurality of cylinders being connected to the inlet port by a respective inlet passage in a plurality of inlet passages and to the outlet port by a respective outlet passage in a plurality of outlet passages. The piston pump has a plurality of pistons, each piston in the plurality of pistons being disposed in a respective cylinder in the plurality of cylinders. A drive shaft drives the plurality of pistons within their respective cylinders. A throttle member independently throttles flow in each inlet passage in the plurality of inlet passages. The pump system can further comprise an electrohydraulic actuator governing movement of the throttle member.

In further embodiments, the pump system has a piston pump comprising a cylinder block having an inlet port, an outlet port, and a plurality of cylinders disposed therein, each cylinder in the plurality of cylinders being connected to the inlet port by a respective inlet passage in a plurality of inlet passages and to the outlet port by a respective outlet passage in a plurality of outlet passages. The piston pump can have a plurality of pistons, each piston in the plurality of pistons being disposed in a respective cylinder in the plurality of cylinders. A drive shaft drives the plurality of pistons within the respective cylinders. A throttle member independently throttles flow in each inlet passage in the plurality of inlet passages. The pump system can further comprise a load sense apparatus governing movement of the throttle member based upon a load sense signal and an electrohydraulic actuator governing movement of the throttle member based upon an electronic signal.

In further embodiments, the pump system has a piston pump comprising a cylinder block having an inlet port, an outlet port, and a plurality of cylinders disposed therein, each cylinder in the plurality of cylinders being connected to the inlet port by a respective inlet passage in a plurality of inlet passages and to an outlet port by a respective outlet passage in a plurality of outlet passages. The piston pump can have a plurality of pistons, each piston in the plurality of pistons being disposed in a respective cylinder in the plurality of cylinders. A drive shaft drives the plurality of pistons within the respective cylinders. A throttle member independently throttles flow in each inlet passage in the plurality of inlet passages. The pump system can further comprise a load sense apparatus governing movement of the throttle member based upon a load sense signal and an electrically operated actuator governing movement of the throttle member based upon an electronic signal.

DETAILED DESCRIPTION OF THE DRAWINGS

Figure 1:
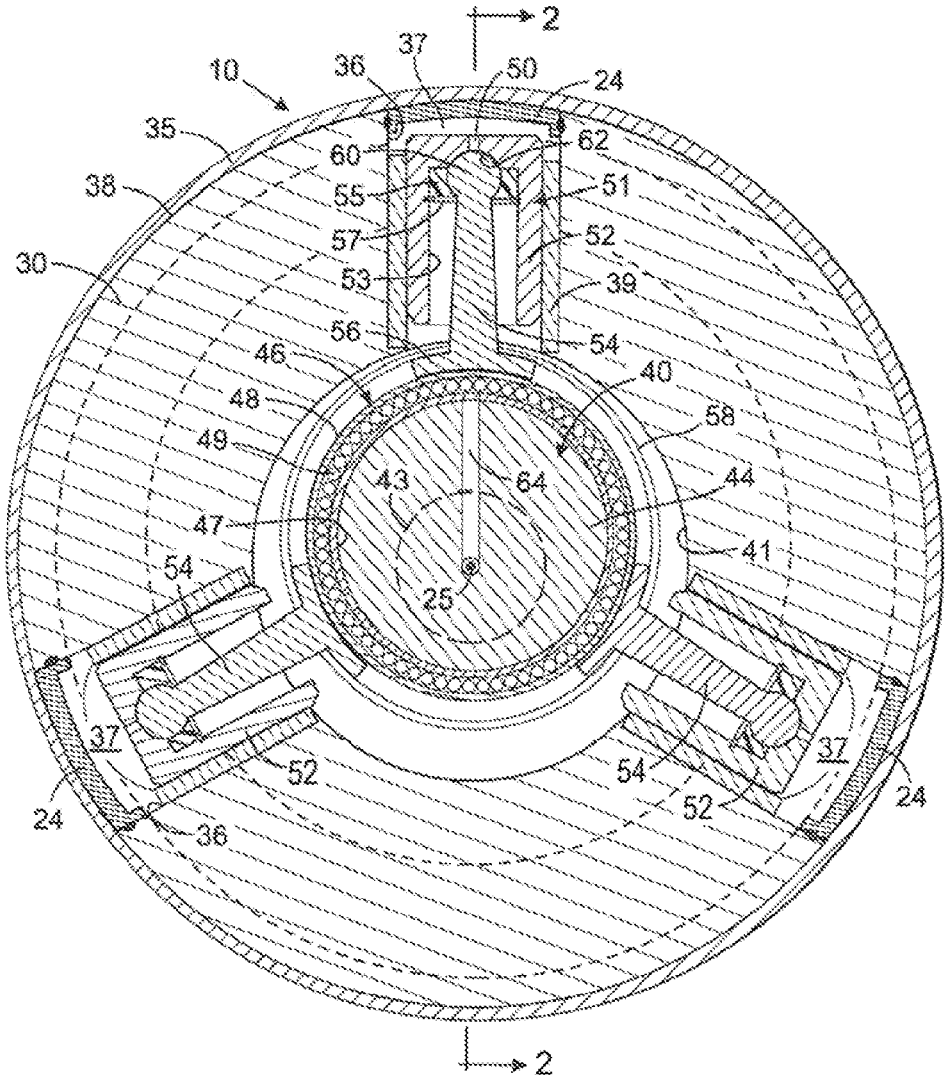
FIG. 1 is a radial cross section showing arrangement of cylinders and pistons in a pump.
Figure 2:
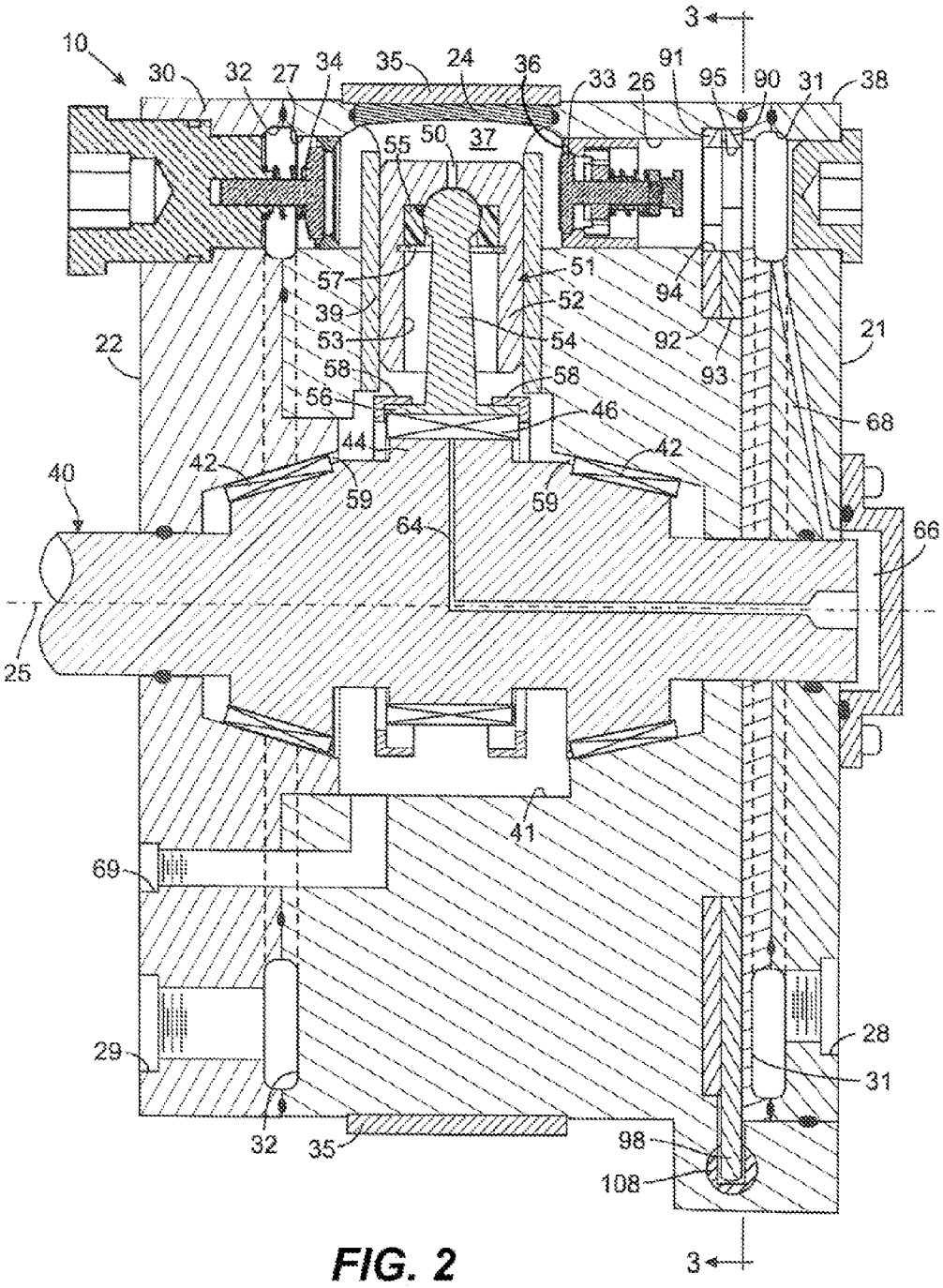
FIG. 2 is an axial cross section through the pump along line 2-2 in FIG. 1.

With reference to FIGS. 1 and 2, a hydraulic pump 10 has a cylinder block 30 with exterior first and second end surfaces 21 and 22 between which a cylindrical exterior side surface 38 extends. Although a radial piston pump is shown herein, the following structures and systems could also be incorporated with and/or incorporate a wobble plate pump, or any non-variable displacement pump or the like. The cylinder block 30 has an inlet port 28 and an outlet port 29 through which hydraulic fluid is received and expelled from a hydraulic system. The inlet and outlet ports 28 and 29 open into inlet and outlet galleries 31 and 32, respectively, that extend in circles through the cylinder block 30 around a central shaft bore 41 in the cylinder block 30. Three cylinders 36 extend radially outward from and are oriented at 120 degree increments around the central shaft bore 41. Although the exemplary pump 10 is illustrated with three cylinders to simplify the drawings, in practice the pump may have a greater number of cylinders (e.g., 6 or 8 cylinders) to reduce torque, flow and pressure ripples at the outlet. Each cylinder 36 includes a tubular sleeve 39 that is inserted into a bore in the cylinder block 30. Although the tubular sleeve 39 is beneficial in reducing the diameter of the pump 10 as will be described, the sleeve can be eliminated by using a material for the cylinder block that can be machined to form the cylinder bores. Each cylinder 36 has an opening through the cylindrical side surface 38 of the cylinder block 30. A sealing cup 24 with an O-ring is placed inside each opening and a continuous band-shaped closing ring 35 extends around the side surface 38 tightly closing each of the cylinder openings. The closing ring 35 eliminates the relatively long plugs that projected outward from the cylinders in conventional pump designs and thereby reduces the overall diameter of the pump 10.

With particular reference to FIG. 2, a plurality of inlet passages 26 are formed by first bores that extend into the first end surface 21 of the cylinder block 30 and each inlet passage opens into both the inlet gallery 31 and a respective one of the cylinders 36. In other words, each inlet passage 26 is directly connected to both the inlet gallery 31 and one of the cylinders 36. A separate inlet check valve 33 is located in each of those inlet passages 26. The inlet check valve 33 opens when the pressure within the inlet passage 26 is greater than the pressure within the associated cylinder chamber 37, as occurs during the intake phase of the pumping cycle. A plurality of outlet passages 27 are formed by second bores that extend into the second end surface 22 of the cylinder block 30 with each outlet passage opening into both the outlet gallery 32 and a respective one of the cylinders 36. Every outlet passage 27 is directly connected to both the outlet gallery 32 and one of the cylinders 36. A separate outlet check valve 34 is located in each of those outlet passages 27. The outlet check valve 34 opens when pressure within the associated cylinder chamber 37 is greater than the pressure within the outlet gallery 32, as occurs during the exhaust phase of the pumping cycle. It should be understood that the inlet and outlet galleries 31 and 32 communicate with all the piston cylinders in the pump and an identical pair of check valves is provided for each cylinder. As depicted in FIG. 2, each of the inlet and outlet check valves 33 and 34 is passive, meaning that it operates in response to pressure exerted thereon and not by an actuator, such as an electric solenoid. However, the scope of the present disclosure also covers inlet and outlet values that are actuated by other than pressure exerted thereon.

The tubular sleeve 39 that partially forms the cylinder 36 enables the inlet and outlet check valves 33 and 34 to be placed closer to the longitudinal axis 25 of the drive shaft 40. Note that the inlet and outlet check valves 33 and 34 are within the closed curved perimeter defined by the exterior side surface 38 of the cylinder block 30. In prior configurations the valves had to be outward from the top dead center position of the piston in order to receive the fluid forced out of the cylinder chamber 37. As shown in FIG. 2, the tubular sleeve 39 extends partially over the opening between the cylinder chamber 37 and the bores in which the inlet and outlet check valves 33 and 34 are located, thereby extending the cylinder bore farther into the cylinder chamber 37.

Referring again to both to FIGS. 1 and 2, a drive shaft 40 extends through the central shaft bore 41 and is rotatable therein being supported by a pair of bearings 42. The center section of the drive shaft 40 within the cylinder block 30 has an eccentric cam 44. The cam 44 has a circular outer surface, the center of which is offset from longitudinal axis 25 of the drive shaft 40. As a consequence, as the drive shaft 40 rotates within the cylinder block 30, the eccentric cam 44 rotates in an eccentric manner about the axis 25 of the drive shaft. As specifically shown in FIG. 1, a cam bearing 46 has an inner race 47 that is pressed onto the outer circumferential surface of the eccentric cam 44 and an outer race 48. A plurality of rollers 49 are located between the inner race 47 the outer race 48 of the cam bearing. With the proper heat treatment and surface finishing, the surface of the eccentric cam 44 can serve as the inner bearing race. The cam bearing 46 improves the efficiency of the pump 10 over previous pumps that used a sliding journal bearing for this function. The rollers may be cylindrical, spherical, or other shapes.

A separate piston assembly 51 is slideably received within each of the cylinders 36. Every piston assembly 51 has a piston 52 and a piston rod 54. The piston rod 54 extends between the piston 52 and the cam bearing 46. The piston rod 54 has a curved shoe 56 which abuts the outer race 48 of the cam bearing 46. The curved shoe 56 is wider than the shaft of the piston rod, creating a flange portion. A pair of annular retaining rings 58 extends around the eccentric cam 44 engaging the flange portion of each curved shoe 56, thereby holding the piston rods 54 against the cam bearing 46, which is particularly beneficial during the intake stroke portion of a pumping cycle. The annular retaining rings 58 eliminate the need for a spring to bias the piston assembly 51 against the cam bearing 46. The curved shoe 56 evenly distributes the piston load over a wide area of the cam bearing 46. As the drive shaft 40 and eccentric cam 44 rotate within the cylinder block 30, the outer race 48 of the cam bearing 46 remains relatively stationary. The outer race 48 rotates at a very slow rate in comparison to the speed of the drive shaft 40 and the inner race 47. Therefore, there is little relative motion between each curved shoe 56 and the cam bearing's outer race 48.

The piston 52 is cup-shaped having an interior cavity 53 which opens toward the drive shaft 40. An end of the piston rod 54 is received within the interior cavity 53 and has a partially spherical head 60 that fits into a mating partially spherical depression 62 in the piston 52. The head of the piston 52 may have an aperture 50 there through to convey hydraulic fluid from the cylinder chamber 37 to lubricate the interface between the spherical head 60 and the piston 52. The piston rod 54 is held against the piston 52 by an open single bushing or a split bushing 55 and a snap ring 57 that rests in an interior groove in the piston's interior cavity 53. The piston rod 54 follows the eccentric motion of the eccentric cam 44 and the piston 52 in turn follows by sliding within the cylinder 36. The bushing and snap ring arrangement allows the spherical head 60 of the piston rod to pivot with respect to the piston 52 when a rotational moment is imposed onto the piston rod 54 by rotation of the eccentric cam 44. Because of that pivoting, the rotational moment is not transferred into the piston 52, thereby minimizing the lateral force between the piston and the wall of the cylinder 36.

With continuing reference to FIG. 2, the drive shaft 40 includes an internal lubrication passage 64 extending from one end of the drive shaft 40 to the outer surface of the eccentric cam 44. The lubrication passage 64 has a single opening in the outer surface of the eccentric cam 44 at the center of the eccentric apex of the cam 44 to feed fluid into the cam bearing 46. The other end of the lubrication passage 64 opens into a chamber 66 at the end of the drive shaft 40 and that chamber receives relatively low pressure fluid through a feeder passage 68 from the inlet gallery 31. As the drive shaft 40 rotates, centrifugal force expels fluid from the lubrication passage 64 into the cam bearing 46. This action draws additional fluid into the lubrication passage 64 from the chamber 66, thereby providing a pumping function for fluid that lubricates the cam bearing 46. If the cam bearing 46 has an inner race 47, that inner race has apertures that convey the lubricating fluid to the rollers 49. The outer race 48 also has through holes to lubricate the shoes 56 of the piston rods 54, thereby providing splash lubrication and eliminating a need to have the central shaft bore 41 filled with fluid. Not having the crankcase filled with fluid reduces windage drag on the eccentric cam 44 and improves efficiency of the pump. Additional lubricating passages 59 are provided to convey fluid from the central shaft bore 41 to the bearings 42 for the drive shaft 40. The fluid used for lubrication exits the central shaft bore 41 through a standard drain port 69 from which the fluid is conveyed to a tank for the hydraulic system.

Pumping Operation

Rotation of the eccentric cam 44 causes each piston 52 to move cyclically within the respective cylinder 36, away from the sealing cup 24 during a fluid intake phase and then toward the sealing cup 24 during a fluid exhaust phase. Because of the radial arrangement of the cylinders 36, at any point in time, some pistons 52 are in the intake phase while other pistons are in the exhaust phase.

The piston 52 illustrated in FIG. 2 is at a top dead center position when the volume of its cylinder chamber 37 is the smallest, which occurs at a transition point from the exhaust phase to the intake phase during each piston cycle. From this point, the outlet check valve 34 closes and further rotation of the eccentric cam 44 moves the piston 52 into the intake phase. During the intake phase, the volume of the cylinder chamber 37 increases, thereby initially decompressing the fluid remaining therein which tends to drive or put energy back into the drive shaft 40. Thereafter, further increase in the cylinder volume produces a lower pressure in cylinder chamber 37 than in the inlet gallery 31, therefore forcing the inlet check valve 33 open. Thus, fluid flows from the inlet gallery 31 through the inlet passage 26 and the inlet check valve 33 into the expanding cylinder chamber 37. At this time, when there is a low pressure in the cylinder chamber 37, the pressure in the outlet gallery 32 is higher due to either the flow output of the other cylinder chambers passing through a restriction or a static or dynamic load on the output. That pressure differential forces the outlet check valve 34 closed against its valve seat.

Thereafter, further rotation of the eccentric cam 44 moves the piston 52 into the exhaust phase during which the piston moves outward, away from the center axis 25. That motion initially compresses the fluid in the cylinder chamber 37, thereby increasing the pressure of that fluid. Soon the pressure in the cylinder chamber 37 is approximately that same as the pressure in the inlet passage 26, at which point the associated spring closes the inlet check valve 33. Eventually, the cylinder chamber pressure exceeds the pressure in the outlet gallery 32 and forces the outlet check valve 34 open, releasing the fluid from the cylinder chamber 37 into the outlet gallery and to the outlet port 29.

When continued rotation of the eccentric cam 44 moves the piston 52 to the top dead center position shown in FIG. 2, the exhaust phase is complete and thereafter the piston transitions into the intake phase of another pumping cycle.

Because the inlet and outlet check valves 33 and 34 open and close almost immediately at the top dead center and bottom dead center positions, essentially the entire piston cycle is use to draw fluid into the cylinder chamber and then expel that fluid. This is in contrast to prior pumps that had throttle plates, but relied on the position of the piston to open and close an inlet opening into the cylinder. Those prior pumps had a dead region, which in some cases was one third the piston cycle, during which fluid was neither being drawn into nor expelled from the cylinder chamber. Thus with the present pump configuration an equivalent fluid volume can be pumped by each piston cycle with less piston stroke distance. This feature contributes to the compact size of the present pump.

Throttle Member Operation

Figure 3:
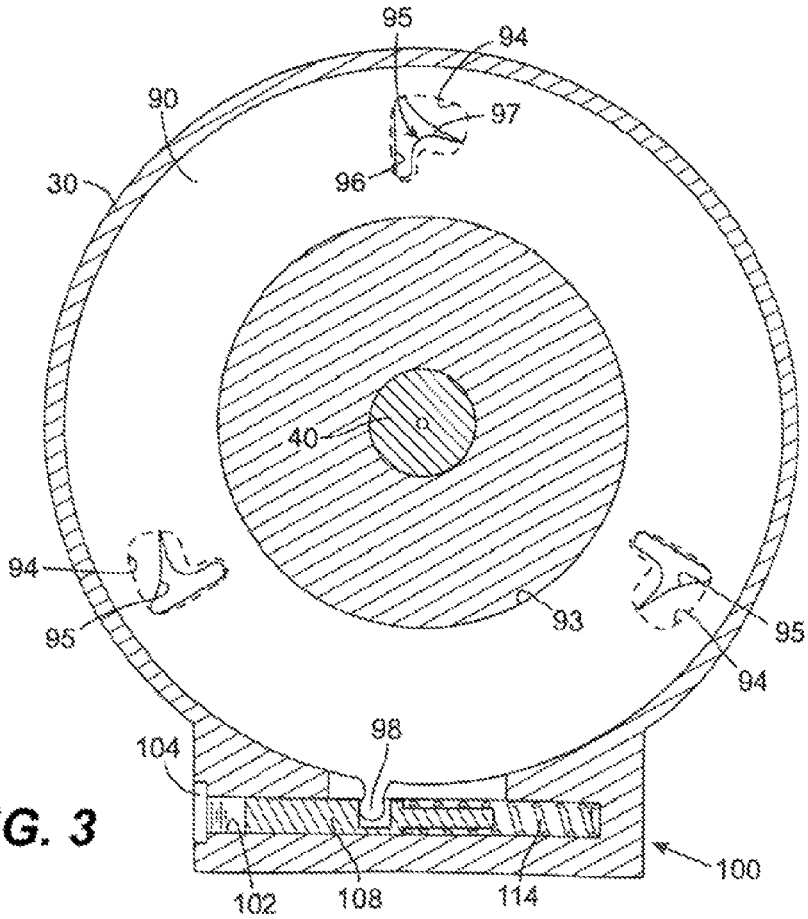
FIG. 3 is a radial cross section through the pump along line 3-3 in FIG. 2, showing a throttle member having apertures that are in fully open states.

With reference to FIGS. 2 and 3, the pump 10 includes a throttle mechanism that varies the inlet opening area from the shared inlet gallery 31 into the inlet passage 26 and through the inlet check valve 33 for each cylinder 36 during the intake phase. The throttle mechanism can take many forms, including a single spool with multiple lands or a series of spools or poppets; a cam or other device that limits the maximum opening of the inlet check valves 33 such that the inlet check valves 33 are also metering members; a nozzle-type restriction with a plate that moves axially rather than radially; or one or more electrically operated or pilot-pressure-operated valves associated with the cylinders 36. One embodiment of the throttle mechanism, as shown in FIGS. 2 and 3, has a throttle member 90 and an abutting transition plate 91 that are sandwiched between two sections of the cylinder block 30 so as to extend across each of the plurality of inlet passages 26. The throttle member 90 and the transition plate 91 have central apertures 92 and 93, respectively through which the drive shaft 40 extends. The transition plate 91 is held stationary within the cylinder block 30 and has a plurality of transmission apertures 94, each fixedly aligned with one of the inlet passages 26. The throttle member 90 is rotatable around the drive shaft 40 and has a plurality of control apertures 95 proximate to the transmission apertures 94 in the transition plate 91. The control apertures 95 of the throttle member 90 and the transmission apertures 94 in the transition plate 91 are formed on nearly the same radius as that of the inlet passages 26, thus assuring registration of those apertures with the inlet passages upon rotation of the throttle member 90 through a predefined arc. As will be described, rotation of the throttle member 90 aligns and misaligns the control apertures 95 with the transmission apertures 94, thereby creating variable orifices that control the fluid flow between the inlet gallery 31 and the cylinders 36.

The pump 10 further includes a hydraulic actuator 100 for rotating the throttle member 90 within the cylinder block 30. For that purpose, a tab 98 projects outward from the outer edge of the throttle member 90 and into an actuator bore 102 in the cylinder block 30. The actuator bore 102 has a control port 104 to which a hydraulic conduit from a control circuit connects. A control piston 108 is slideably received in the actuator bore 102 and engages the tab 98 of the throttle member 90. Pressurized fluid applied to the control port 104 drives the control piston 108 to the right in the actuator bore 102 (see FIG. 3), thereby causing the throttle member 90 to rotate into different positions such as those shown in FIG. 4. Alternatively the hydraulic actuator 100 could include a rack and pinion type of arrangement; a rotary piston; or a worm gear with a hydraulic motor, an electric stepper motor, a linear solenoid, a rotary solenoid, or another similar electromechanical actuator.

The angular position of the throttle member 90 within the cylinder block 30 determines the alignment of the control apertures 95 in the throttle member with the transmission apertures 94 in the transition plate 91. Varying that alignment alters the degree to which those apertures overlap and thus alters the cross sectional area through which fluid is able to flow between the inlet gallery 31 and the cylinders 36 during the piston cycle intake phase. In other words, the adjustable alignment of the transmission and control apertures 94 and 95 forms a variable orifice in that flow path provided by the inlet passages 26. Both the control apertures 95 and the transmission apertures 94 may have unique shapes so that fluid flow varies in a specific manner to regulate the displacement of the pump 10 and maintain the output pressure at a desired level. FIG. 3 illustrates the control apertures 95 and the transmission apertures 94 in a fully aligned orientation that provides the maximum flow between the inlet gallery 31 and cylinders 36. As the throttle member 90 rotates counter clockwise and the transmission and control apertures 94 and 95 become misaligned to greater degrees, the area of that variable orifice initially changes at a relatively high rate until reaching the position depicted in FIG. 4. As the orifice area thereafter becomes smaller, the rate that the area changes decreases, i.e., the area changes more slowly for identical increments of change in the angular position of the throttle member 90.

In one embodiment, the variation in the rate of orifice area change is determined by the unique shape of the transverse cross section of the control apertures 95 in the throttle member 90. Transverse cross section as used herein means a cross section across a control aperture 95 in a plane that is transverse to the direction that fluid flows through the control aperture 95. As shown in FIG. 3, each control aperture 95 has a transverse cross sectional shape that has an oval primary region 96 from which a tapered region 97 projects, like a beak of a bird, and terminates at an apex. The primary region 96 has a relatively large cross sectional area as compared to the cross sectional area of the tapered region 97. The control apertures 95 can have other shapes and still attain variation of the rate of change of the fluid flow, as described herein. In other embodiments, the control apertures 95 do not vary the rate of change of fluid flow, and such rate of change remains constant no matter the angle of rotation of the throttle member 90. Each transmission aperture 94 in the transition plate 91 has a size and shape which ensures that the entire cross sectional area of the associated control aperture 95 communicates with the inlet passage 26 when the throttle member 90 in the fully aligned position. That full alignment of the transmission and control apertures 94 and 95 enables the entire area of the control aperture 95 to conduct fluid through the throttle member 90 and thus provides the maximum flow of fluid from the inlet gallery 31 into each cylinder 36 during the intake phase of the piston cycle. A spring 114 biases the control piston 108 into a position in which the throttle member 90 is in the fully aligned aperture position.

From the fully aligned position in FIG. 3, application of pressurized fluid to the control port 104 drives the control piston 108 which acts on the tab 98 rotating the throttle member 90 counter clockwise. Continued motion eventually moves the throttle member 90 into an intermediate position depicted in FIG. 4. As the throttle member 90 moved between those positions the larger primary regions 96 of the control apertures 95 move over the edge of the transmission apertures 94 in the transition plate 91, thereby closing off some of the area of each transmission aperture 94. Because of the large size of the oval primary regions 96, the area through which fluid flows through the orifice, created by the control apertures 95 and the transmission apertures 94, diminishes at a relatively fast rate. That is, for a given incremental distance that the control piston 108 moves and thus for a given incremental angular change in throttle member 90 position, a relatively large change in flow occurs.

Figure 4:
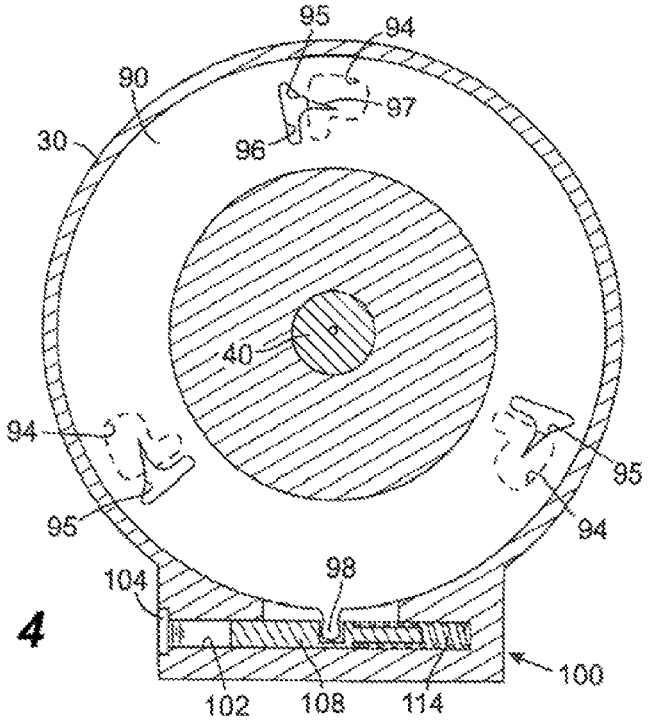
FIG. 4 shows another position of the throttle member in which the apertures are in partially open states.

Upon reaching the intermediate position in FIG. 4, only the tapered regions 97 of the control apertures 95 remain aligned to communicate with the transmission apertures 94 in the transition plate 91. Thus fluid can only flow through the throttle member 90 via those tapered regions 97. In this intermediate position, the control apertures 95 are only partially aligned with the transmission apertures 94 in the transition plate 91. Depending upon the amount of overlap in this intermediate position, the amount of flow between the inlet gallery 31 and each of the inlet passages 26 is reduced from the fully aligned position.

The amount of this flow can be proportionally controlled by controlling the rotational position of the throttle member 90 and thus the amount of that aperture overlap. As the rotation of the throttle member 90 continues, the tapered regions 97 cause the flow area to change at a smaller rate than occurred during previous motion to reach that intermediate position from the fully aligned position of the transmission and control apertures 94 and 95. Now for each given incremental distance that the control piston 108 moves and for each given incremental angle change of the throttle member 90, a relatively smaller change in flow area occurs than happened previously. Therefore, the rate that the open area of the control apertures 95 changes decreases as that open area becomes smaller.

Continued activation of the hydraulic actuator 100 results in the throttle member 90 eventually reaching a position in which the control apertures 95 are entirely misaligned with the transmission apertures 94 in the transition plate 91. That is, no part of the control apertures 95 overlaps or opens into the transmission apertures 94 and fluid flow between the inlet gallery 31 and the cylinders 36 is blocked.

The use of a throttle member 90 to control the amount of flow between the inlet gallery 31 and the inlet passages 26 enables the displacement of the pump 10 to be dynamically varied. When the control apertures 95 are only partially aligned with the transmission apertures 94, the amount of fluid flowing into the cylinder chamber 37 during the intake phase of each piston cycle is reduced. As a result, the piston 52 reaches bottom dead center without the cylinder chamber 37 being completely filled with hydraulic fluid. Thus, a portion of the total effective piston displacement is lost. The amount of lost displacement does not vary significantly as a function of the speed of the pump 10, since the average pressure drop across the throttle member 90 is constant for typical pump speeds of 800 to 2500 RPM.

The present pump configuration with the rotatable throttle member 90 provides variable throttle choking at the input of each inlet check valve 33. This has a significant advantage over a pump that has throttle choking at a single place for all the cylinders 36, such as between the inlet port 28 and the inlet gallery 31. With the per inlet check valve throttling arrangement of the present pump 10, the fluid volume between the throttle member 90 and the inlet check valve 33 is relatively small and results in improved consistency and dynamic response in both starting and stopping fluid flow.

Although the above example shows and describes decreased output flow when pressurized fluid is applied to the control port 104, it is also contemplated that a decrease in the pressure in the hydraulic actuator 100 could decrease output flow at the outlet port 29, depending on configuration of the throttle member 90 with respect to the transition plate 91 and with respect to the hydraulic actuator 100.

Pump Systems

Figure 6:
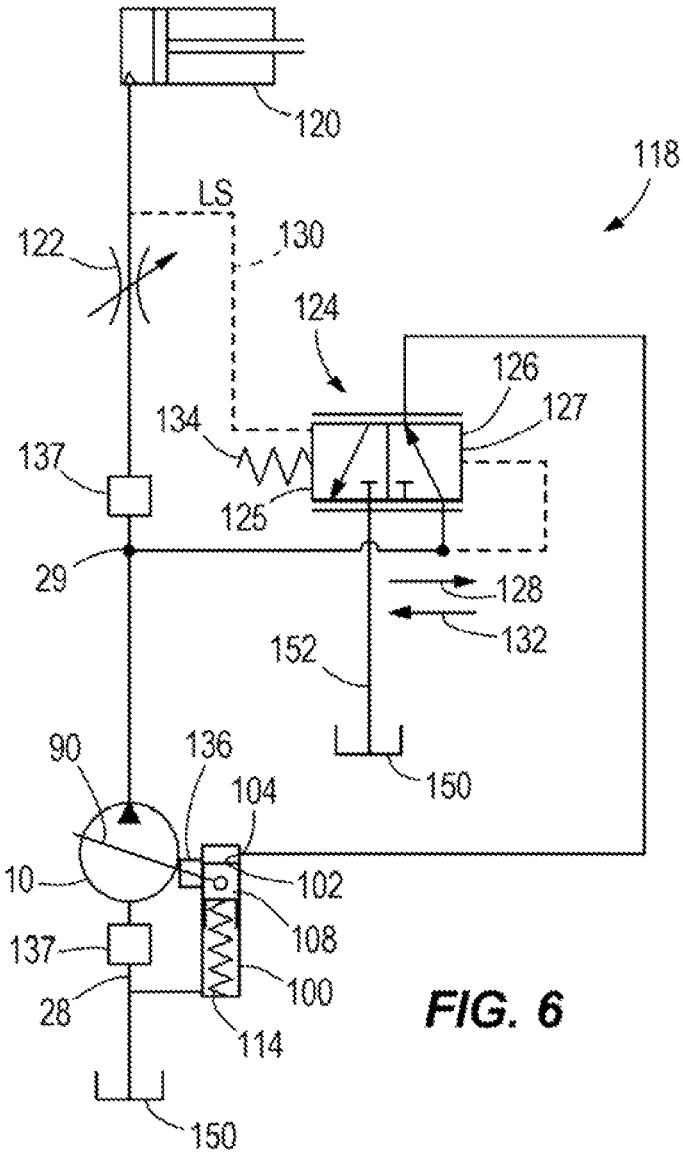
FIG. 6 shows a pump system incorporating a load sense apparatus.

FIG. 6 depicts a pump system 118. The pump system 118 has a piston pump 10. As described herein above with reference to FIGS. 1 and 2, the pump 10 has a cylinder block 30 having an inlet port 28, an outlet port 29, and a plurality of cylinders disposed therein, each cylinder 36 in the plurality of cylinders being connected to the inlet port 28 by a respective inlet passage 26 in a plurality of inlet passages and to the outlet port 29 by a respective outlet passage 27 in a plurality of outlet passages. The piston pump 10 has a plurality of pistons, each piston 52 in the plurality of pistons being disposed in a respective cylinder 36 in the plurality of cylinders. The piston pump 10 has a drive shaft 40 driving the plurality of pistons 52 within the respective cylinders 36. The pump 10 also has a throttle member 90 independently throttling flow in each inlet passage 26 in the plurality of inlet passages. The throttle member 90 may be like that shown and described in FIGS. 3 and 4, or may take other forms as described hereinabove. The pump system 118 further has a hydraulic actuator 100 moving the throttle member 90 to throttle flow in each in inlet passage 26 in the plurality of inlet passages. The hydraulic actuator 100 may include a control piston 108 and the pressure in the hydraulic actuator 100 acts on the control piston 108 to move the throttle member 90. The pump system 118 further has a load sense apparatus 124 that modulates a pressure in the hydraulic actuator 100, thereby governing movement of the throttle member 90. The load sense apparatus 124 may include a margin spool 126, the margin spool 126 being biased in a first direction shown by the arrow 128, being moveable in the first direction 128 by a load sense signal LS in line 130, and being moveable in a second, different direction (shown by the arrow 132) against the bias and the load sense signal LS in line 130 by a pressure at the outlet port 29, thereby modulating the pressure in the hydraulic actuator 100 as described further herein below. The margin spool 126 is biased for example, by a spring 134.

In one embodiment of the pump system 118, a user operates a control valve 122 to vary the rate at which fluid flows from the pump 10 to a hydraulic actuator 120 on a machine. This operation results in a pressure drop across the control valve 122. The margin spool 126 is set to a predetermined bias force provided by a pre-load of the spring 134. Pressure from an outlet port 29 acts on the non-spring end 127 of the margin spool 126, and a load sense signal LS in line 130 (which in this example is pressure downstream of the control valve 122) acts on the spring end 125 of the margin spool 126. The position of the margin spool 126 will adjust to balance the predetermined force of the spring 134 and the two applied pressures, thereby modulating flow into or out of the hydraulic actuator 100, more specifically through the control port 104 and into the actuator bore 102. The flow into and out of the hydraulic actuator 100 either increases or decreases pressure in the actuator bore 102, which in turn adjusts the output flow of the pump 10 by moving the throttle member 90.

If the output flow of the pump 10 is lower than the operator-set desired flow rate, the margin spool 126 will shift in the direction of arrow 128 to allow flow out of the hydraulic actuator 100 through a drain connection 152 to a tank 150. When fluid flows out of the hydraulic actuator 100, the spring 114 moves in a direction that moves the throttle member 90 to increase the output flow of the pump 10. The throttle member 90 rotates such that the control apertures 95 and the transmission apertures 94 are more aligned than they previously had been. The output flow of the pump 10 will increase until balance with the predetermined force of the spring 134 has been achieved. If the output flow of the pump 10 is greater than the operator-set desired flow rate, the margin spool 126 will shift in the direction of arrow 132 to allow flow from the outlet port 29 into the hydraulic actuator 100. This moves the control piston 108 against the spring 114 in a direction that moves the throttle member 90 to decrease the output flow of the pump 10. The throttle member 90 rotates such that the control apertures 95 and the transmission apertures 94 are less aligned than they previously had been. The output flow of the pump 10 will decrease until balance with the predetermined force of the spring 134 has been achieved. Other embodiments of load sense apparatuses that function based on a load sense signal LS in line 130 created by other than adjusting a restriction of a control valve 122 are contemplated within the scope of the present disclosure. For example, a load sense signal can be generated by sensing the highest load of the pump system 118 with a system of logic values or can be generated by an electrohydraulic device.

With further reference to FIG. 6, in one embodiment, the pump system 118 further includes a position sensor 136 sensing a position of the throttle member 90 or the control piston 108. In a further embodiment, the pump system 118 further includes at least one pressure sensor 137 sensing a pressure at one or both of the inlet port 28 and the outlet port 29.

Figure 7:
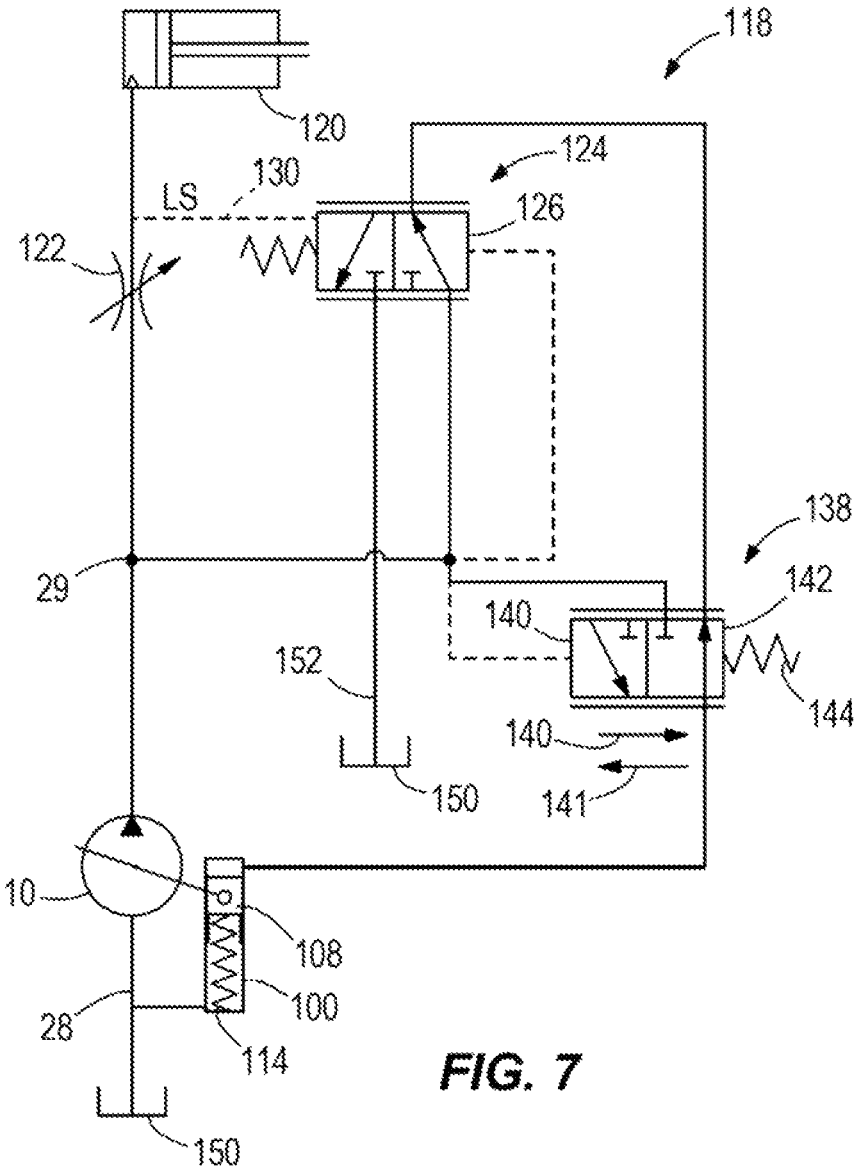
FIG. 7 shows a pump system incorporating a load sense apparatus and a pressure compensator valve.

Now with reference to FIG. 7, a pump system 118 having a pressure compensator valve 138 will be described. Like reference numbers in FIGS. 6 and 7 describe like parts and will not be further described. In the embodiment of FIG. 7, a pressure compensator valve 138 references a pressure at the outlet port 29 of the pump 10 and overrides modulation of pressure in the hydraulic actuator 100 by the load sense apparatus 124 if pressure at the outlet port 29 exceeds a predetermined limit. A first end 140 of the pressure compensator valve 138 references the pressure at the outlet port 29 of the pump 10. A second end 142 of the pressure compensator valve 138 has a spring 144 that biases the pressure compensator valve 138 in a direction opposite the effect of the pressure from the outlet port 29. During normal operation, the pump system 118 is controlled by the load sense apparatus 124, as described herein above with reference to FIG. 6. The spring 144 biases the pressure compensator valve 138 in the direction of arrow 141 into a fully open position in which the load sense apparatus 124 modulates pressure in the hydraulic actuator 100 to increase or decrease flow from the pump 10 according to normal functioning of the load sense apparatus 124. Should an operator ever request output pressure from the pump 10 that exceeds a predetermined force set by the spring 144, the pressure compensator valve 138 shifts in the direction of arrow 140. In this instance, pressure from the outlet port 29 overcomes the bias of the spring 144 and the pressure compensator valve 138 shifts in the direction of arrow 140 to allow flow directly from the outlet port 29, through the pressure compensator valve 138, and into the hydraulic actuator 100. This moves the control piston 108 against the spring 114 in a direction that decreases the output flow of the pump 10.

Figure 8:
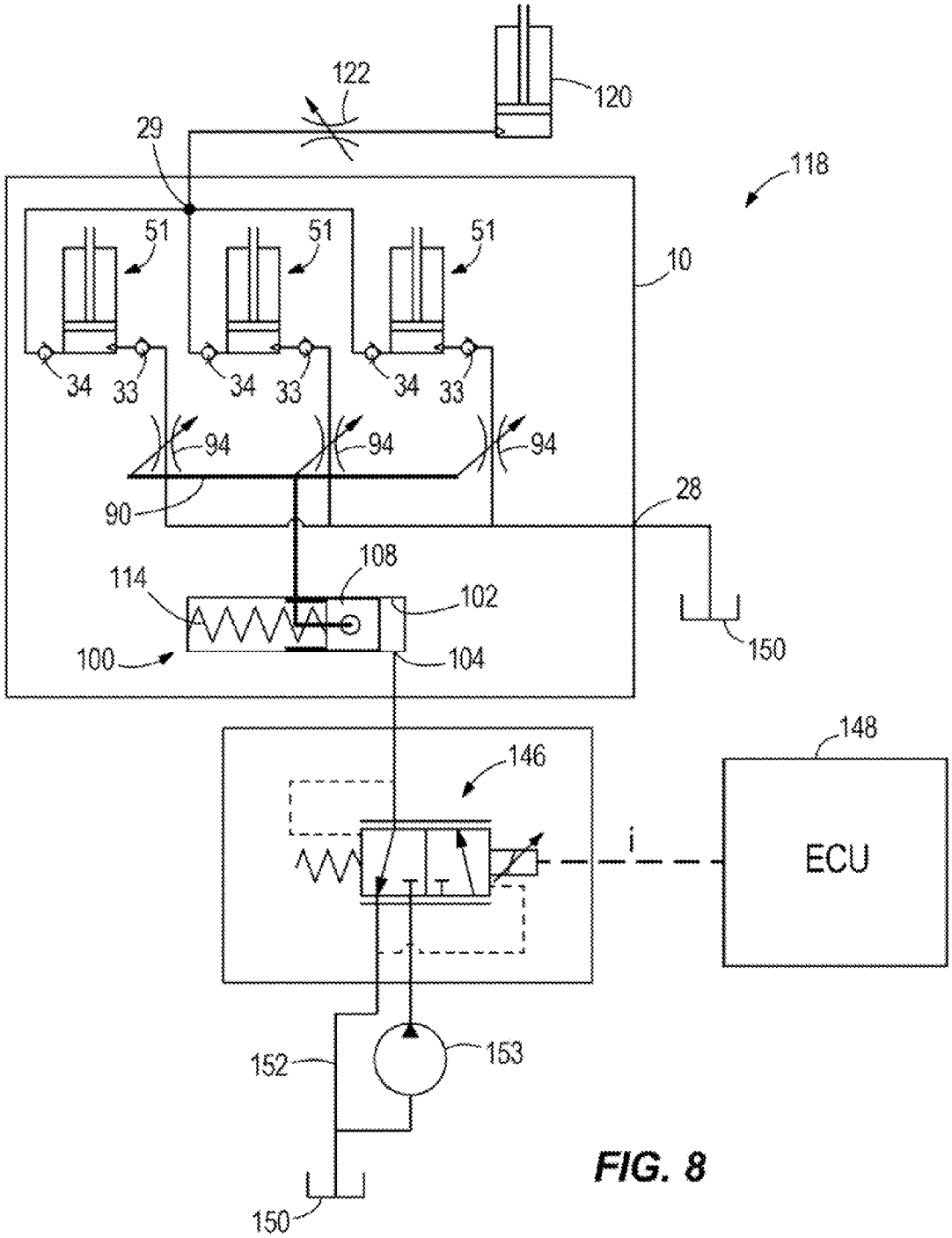
FIG. 8 shows a pump system incorporating an electrohydraulic actuator.

Either or both of the load sense apparatus 124 and the pressure compensator valve 138 shown in FIGS. 6 and 7 can be implemented with the pump systems 118 shown in FIGS. 8-14, although only the load sense apparatus 124 is shown therein. FIG. 8 shows a pump system 118 incorporating an electrohydraulic actuator 146, while FIGS. 9-14 show pump systems 118 incorporating both an electrohydraulic actuator 146 and a load sense apparatus 124 in various configurations for controlling output flow of a pump 10 with either or both of the electrohydraulic actuator 146 and the load sense apparatus 124.

Pump System Control Method

Now with reference to FIG. 5, an exemplary method for controlling an output flow of the pump 10 will be described. At block 2, an input electric current i is provided by a control circuit 148 to an electrically operated actuator. The input electric current i, can be provided to an electrically operated actuator, such as for example an electrohydraulic actuator 146, as will be described further herein below. At block 4, the electrically operated actuator changes position according to the input electric current i. In one example, the electrohydraulic actuator 146 modulates pressure in a hydraulic actuator 100 based on the input electric current i. At 6, a throttle member 90 changes position according to movement of the electrically operated actuator. In one example, the throttle member 90 moves according to the pressure in the hydraulic actuator 100. At block 8, an output flow from the outlet port 29 of the pump 10 corresponds to the position of the throttle member 90, which in turn corresponds to the pressure in the hydraulic actuator 100, which in turn corresponds to the pressure produced by the electrohydraulic actuator 146, which in turn corresponds to the input electric current i.

Figure 5:
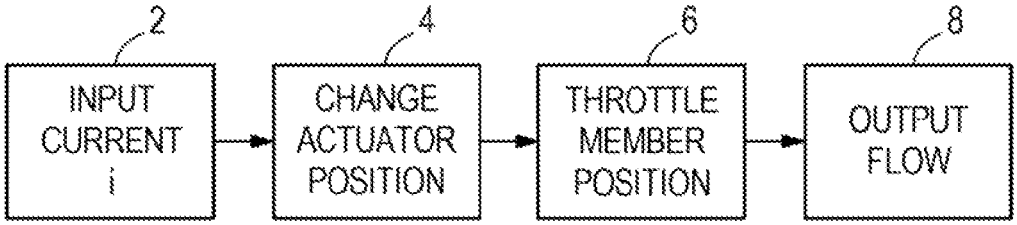
FIG. 5 shows a method for controlling a pump system with an electrically operated actuator.

Non-limiting exemplary systems for carrying out the method of FIG. 5 are described herein below with reference to FIGS. 8-13.

With reference to FIG. 8, the pump system 118 has an electrohydraulic actuator 146 governing movement of the throttle member 90. The electrohydraulic actuator 146 modulates a pressure in the hydraulic actuator 100, thereby governing movement of the throttle member 90, as further described herein below. The pump system 118 may have a control circuit 148 controlling the electrohydraulic actuator 146 to thereby govern movement of the throttle member 90. In one example, the control circuit 148 is an electronic control unit (ECU). In one example, the electrohydraulic actuator 146 is an electrically operated pressure control valve, which can be, for example, an electric pressure reducing valve. An operator inputs a desired flow rate of the pump system 118 into the control circuit 148, which outputs an electronic signal to achieve this desired flow rate. The electrohydraulic actuator 146 receives the electronic signal from the control circuit 148, and responds by moving into a position that increases or decreases pressure in the hydraulic actuator 100. The electrohydraulic actuator 146 does so by removing or refilling hydraulic fluid from the tank 150. The electrohydraulic actuator 146 exhausts fluid from the hydraulic actuator 100 through a drain connection 152. The electrohydraulic actuator 146 refills the hydraulic actuator 100 via a pilot pressure source 153. The pilot pressure source 153 maybe a separate pump as shown or may be taken directly from the outlet port 29 of the pump 10.

In one example, the electronic signal is an electric current i. The electric current i corresponds to an output pressure of the electrohydraulic actuator 146, therefore to a position of the control piston 108 within the hydraulic actuator 100, and in turn to a position of the throttle member 90. The position of the control piston 108 thereby yields a predictable output flow at the outlet port 29 based on this given electric current i, regardless of the speed of the drive shaft 40 or the pressure at the outlet port 29. In other words, the combination of per inlet check valve throttling with a non-variable displacement pump allows for efficient control of a pump system 118 wherein a given electric current i produces a predictable flow at the outlet port 29. This control can be accomplished without need for complex and expensive compensation methods, as is required for electrohydraulic control of variable displacement pumps.

When combined in a pump system 118 with a load sense apparatus 124 and/or pressure compensator valve 138, the position and therefore function of the electrohydraulic actuator 146 can be varied to produce different outcomes, as discussed with reference to FIGS. 9-13.

Figure 9:
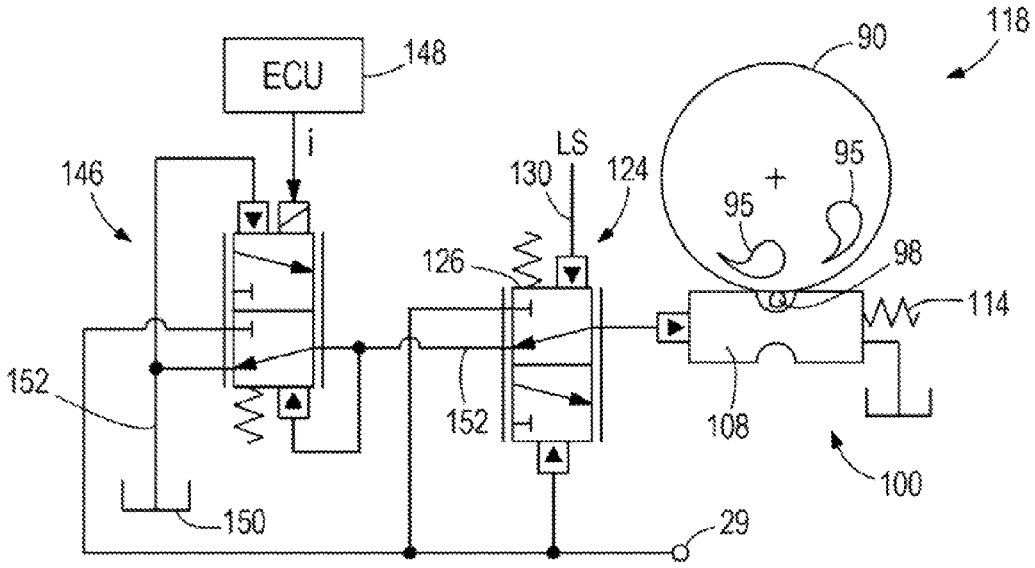
FIG. 9 shows a pump system incorporating an electrohydraulic actuator at a drain connection of a load sense apparatus.
Figure 10:
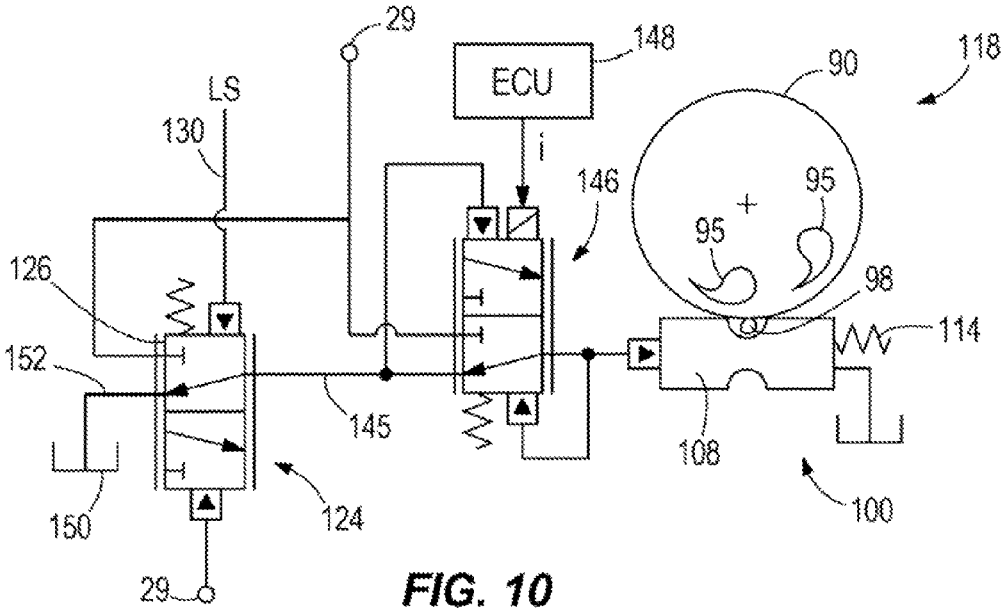
FIG. 10 shows a pump system incorporating an electrohydraulic actuator between a load sense apparatus and a hydraulic actuator.

FIGS. 9-10 depict two systems in which pressure from an electrohydraulic actuator 146 can be added to a pump system 118 having a load sense apparatus 124 to limit the output flow of the pump 10. In the embodiment of FIG. 9, an electrohydraulic actuator 146 is inserted in series with a drain connection 152 of the margin spool 126 and selectively controls pressure in the drain connection 152. When the electrohydraulic actuator 146 is not activated by an electric current i, the spool of the electrohydraulic actuator 146 is biased by a spring into a position that provides a relatively unrestricted path from the drain connection 152 to the tank 150. In this state, the load sense apparatus 124 functions in response to the pump output pressure and the load sense signal LS in line 130, in the same manner as described herein above with respect to FIG. 6, and modulates the pressure in the hydraulic actuator 100 to maintain the desired pump output pressure at the outlet port 29. Alternatively, when the electrohydraulic actuator 146 is energized by the electric current i, the spool of that actuator moves to a position in which a pressure level, derived from the pressure at the pump outlet port 29, is applied to the drain connection 152. That pressure level is defined by the amount that the hydraulic actuator spool is moved by the electric current i. In this state, the drain connection 152 is not tied to the relatively low tank pressure. The pressure applied to the drain connection 152 sets a minimum pressure that can be supplied to the hydraulic actuator 100 and thus sets a maximum area opening position of the pump throttle member 90, i.e., sets a maximum allowed alignment of the control apertures 95 and the transmission apertures 94. Now as the load sense apparatus 124 responds to the pump output pressure and the load sense signal LS in line 130, the pressure supplied to the hydraulic actuator 100 is modulated between the pump output pressure at the outlet port 29 and the minimum pressure level in the drain connection 152.

In the embodiment of FIG. 10, an electrohydraulic actuator 146 is inserted in series with an outlet 145 of the load sense apparatus 124 and the hydraulic actuator 100. The electrohydraulic actuator 146 modulates the pressure in the hydraulic actuator 100 to a pressure level derived from pump output pressure at the outlet port 29 and dependent on the pressure in the outlet 145 of the load sense apparatus 124 and an electric current i. When the electrohydraulic actuator 146 is not activated by the electric current i, the spool of the electrohydraulic actuator 146 is biased by a spring into a position that provides a relatively unrestricted path from the outlet 145 of the load sense apparatus 124 to the hydraulic actuator 100. In this state, the load sense apparatus 124 functions in response to the pump output pressure and the load sense signal LS in line 130 in the same manner as described hereinabove with respect to FIG. 6, and modulates the pressure in the hydraulic actuator 100 to maintain pump output pressure at the outlet port 29. Alternatively, when the electrohydraulic actuator 146 is energized by the electric current i, the spool of the electrohydraulic actuator 146 is biased to a position in which the pressure level in the hydraulic actuator 100 is biased, due to the electric current i, to a level higher than the pressure in the outlet 145 of the load sense apparatus 124. The pressure bias created by the electric current i applied to the electrohydraulic actuator 146 sets a minimum pressure that can be supplied to the hydraulic actuator 100 and thus sets a maximum area opening position of the pump throttle member 90, i.e., sets a maximum allowed alignment of the control apertures 95 and the transmission apertures 94. Now as the load sense apparatus 124 responds to the pump output pressure and the load sense signal LS in line 130, the pressure supplied to the hydraulic actuator 100 is modulated between the pump output pressure at the outlet port 29 and the bias pressure due to the electric current i applied to the electrohydraulic actuator 146.

In other words, in the embodiments of FIGS. 9 and 10, the electrohydraulic actuator 146 and margin spool 126 create a minimum pressure that can be supplied to the hydraulic actuator 100 so as to set a maximum area opening position of the throttle member 90. In the embodiment of FIG. 9, the electrohydraulic actuator 146 modulates a pressure in the margin spool 126 by restricting flow from the margin spool 126 to a drain connection 152, while in the embodiment of FIG. 10 the pressure in the hydraulic actuator 100 is a level of the pressure modulated by the load sense apparatus 124 plus a bias pressure level produced by the electrohydraulic actuator 146.

Now with reference to FIGS. 11 and 12, a pump system 118 that hydraulically selects the higher pressure from the electrohydraulic actuator 146 and the load sense apparatus 124 and uses that pressure to control the hydraulic actuator 100 and thus the flow of the pump system 118 will be described. In other words, the load sense apparatus 124 modulates the pressure in the hydraulic actuator 100 unless a pressure produced by a flow from the electrohydraulic actuator 146 is greater than a pressure produced by a flow from the load sense apparatus 124. The electrohydraulic actuator 146 modulates the pressure in the hydraulic actuator 100 if the pressure produced by the flow from the electrohydraulic actuator 146 is greater than the pressure produced by the flow from the load sense apparatus 124.

An algorithm in the control circuit 148 may limit the maximum flow of the pump 10 such that the flow will not exceed a certain limit for a certain period of time. To achieve this maximum flow limit, the control circuit 148 outputs an electric current i that corresponds to a pressure output of the electrohydraulic actuator 146, therefore to a position of the control piston 108 within the hydraulic actuator 100, and therefore to a position of the throttle member 90. The position of the control piston 108 thereby may yield a predictable maximum flow at the outlet port 29, regardless of drive shaft 40 speed or pressure at the outlet port 29.

If an operator-desired flow does not exceed the maximum flow limit set by the control circuit 148, the pressure produced by the load sense apparatus 124 is therefore higher than the pressure produced by the electrohydraulic actuator 146 and the system operates under control of the load sense apparatus 124. If the operator-desired flow exceeds the maximum flow limit set by the control circuit 148, the load sense apparatus 124 attempts to gain additional flow from pump 10 by reducing the pressure in the hydraulic actuator 100. At the point when the pressure produced by the load sense apparatus 124 falls below the pressure produced by the electrohydraulic actuator 146, a valve will hydraulically change positions and the pressure in the hydraulic actuator 100 and thus flow at the outlet port 29 will be controlled by the electrohydraulic actuator 146 rather than by the load sense apparatus 124. The algorithm of the control circuit 148 is therefore able to limit an operator's command for too much flow at the pump outlet port 29, i.e., for flow that exceeds the maximum flow limit set by the control circuit 148.

On the other hand, when the operator-desired flow once again falls below the maximum flow limit set by the control circuit 148, the valve once again hydraulically changes positions, and the load sense apparatus 124 once more assumes control over flow at the pump outlet 29.

The above-mentioned valve may be a check valve or a shuttle valve, although other valves could be used to achieve the same objective of hydraulically selecting the higher pressure of the electrohydraulic actuator 146 and the load sense apparatus 124.

Figure 11:
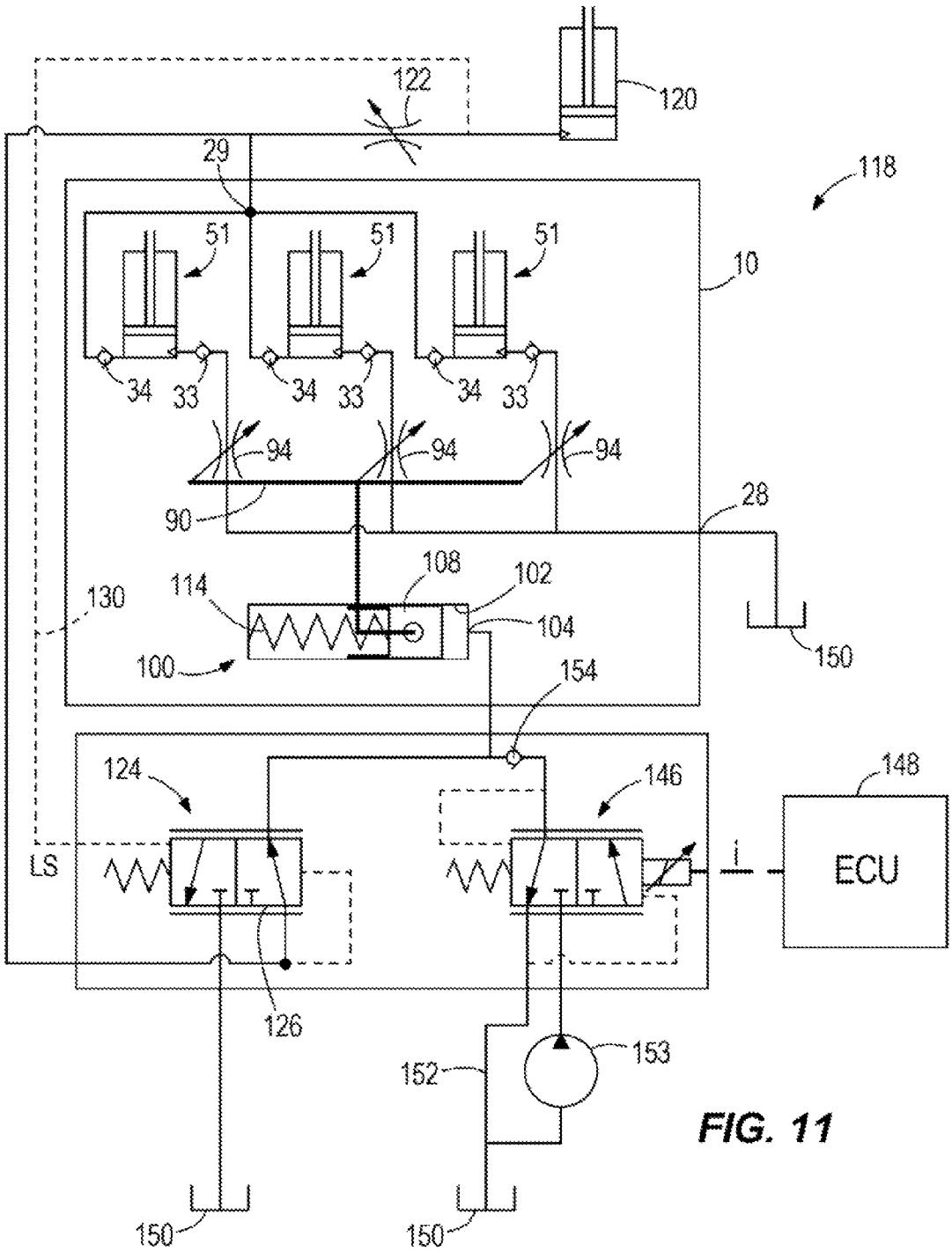
FIG. 11 shows a pump system incorporating an electrohydraulic actuator, a load sense apparatus, and a check valve.

The pump system 118 of FIG. 11 includes a check valve 154 that selectively allows flow from the electrohydraulic actuator 146 to the hydraulic actuator 100 when the pressure produced by the flow from the electrohydraulic actuator 146 is greater than the pressure produced by the flow from the load sense apparatus 124. When the system incorporates a check valve 154, the flow produced by the electrohydraulic actuator 146 saturates the margin spool 126 to control the pressure in the hydraulic actuator 100.

Figure 12:
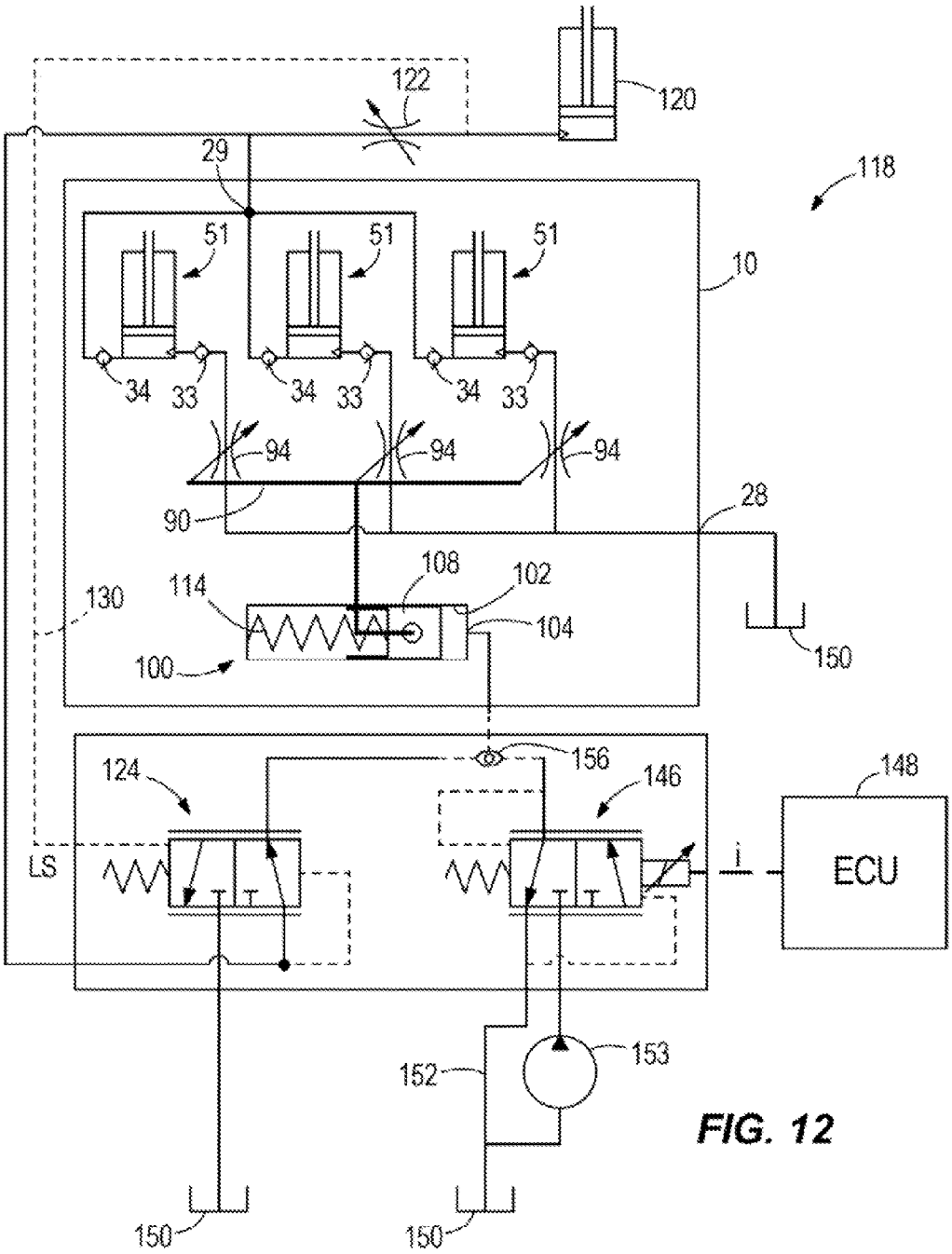
FIG. 12 shows a pump system incorporating an electrohydraulic actuator, a load sense apparatus, and a shuttle valve.

The pump system 118 of FIG. 12 includes a shuttle valve 156 that selectively allows flow from one of the electrohydraulic actuator 146 and the load sense apparatus 124 to the hydraulic actuator 100. When the pressure produced by the flow from the electrohydraulic actuator 146 is greater than the pressure produced by the flow from the load sense apparatus 124, the shuttle valve 156 shuts off the flow from the load sense apparatus 124 to the hydraulic actuator 100. When the pressure produced by the flow from the electrohydraulic actuator 146 is less that the pressure produced by the flow from the load sense apparatus 124, the shuttle valve 156 shuts off the flow from the electrohydraulic actuator 146 to the hydraulic actuator 100.

Figure 13:
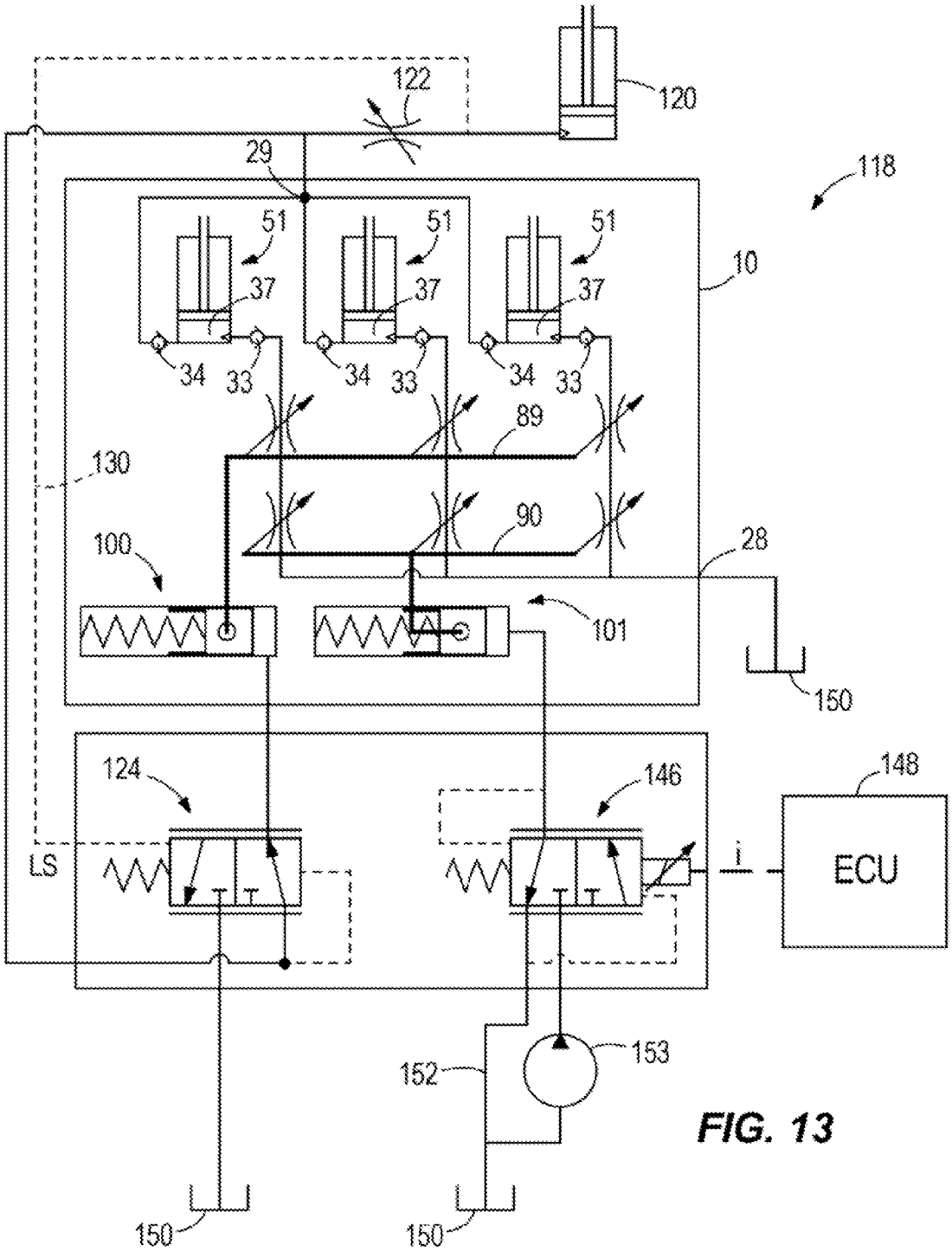
FIG. 13 shows a pump system incorporating an electrohydraulic actuator controlling one throttle member and a load sense apparatus controlling another throttle member.

Now with reference to FIG. 13, an alternative example of the pump system 118 will be described. In this example, the throttle member comprises first and second throttle members 89, 90. The load sense apparatus 124 governs movement of the first throttle member 89 based upon a load sense signal LS in line 130, as described herein above with reference to FIG. 6. The electrohydraulic actuator 146 governs movement of the second throttle member 90 based upon an electronic signal, such as an electric current i, as described herein above with reference to FIG. 8. The hydraulic actuator in this embodiment comprises first and second hydraulic actuators 100, 101. The load sense apparatus 124 governs movement of the first throttle member 89 by modulating a pressure in the first hydraulic actuator 100 and the electrohydraulic actuator 146 governs movement of the second throttle member 90 by modulating a pressure in the second hydraulic actuator 101. In the embodiment shown, the first throttle member 89 is located in series with the second throttle member 90. The order of the two throttle members 89, 90 can be reversed from that shown in FIG. 13.

During normal operation of the load sense apparatus 124, the electrohydraulic actuator 146 will be de-energized and the second throttle member 90 will be fully open so as to provide a negligible amount of restriction into the cylinder chambers 37. Only the first throttle member 89 restricts the flow into the cylinder chambers 37 based on the pressure generated by the load sense apparatus 124. An algorithm in the control circuit 148 may limit the maximum flow of the pump 10 such that the flow will not exceed a certain limit for a certain period of time. When the algorithm determines that an operator-desired flow exceeds the maximum flow limit, the control circuit 148 energizes the electrohydraulic actuator 146 with an electronic signal, such as an electric current i. The electrohydraulic actuator 146 produces a pressure that rotates the second throttle member 90 to a position that corresponds to the electronic signal. The flow at the outlet port 29 then is controlled by the second throttle member 90, until the operator-desired flow drops below the maximum flow limit. This causes the load sense apparatus 124 to produce a pressure in the first hydraulic actuator 100 that causes the position of the first throttle member 89 to be more restrictive than the position of the second throttle member 90 (which corresponds to the maximum flow limit set by the algorithm of the control circuit 148).

By using both a load sense apparatus 124 and an electrohydraulic actuator 146 (and, in some embodiments, a pressure compensator valve 138) within one pump system 118, both the load sense apparatus 124 and the electrohydraulic actuator 146 can govern movement of the throttle member 90 by modulating a pressure in the hydraulic actuator 100. Because per inlet check valve throttling with electrohydraulic control provides predictable output flow for a given electric current i, decoupled from pump outlet pressure and drive shaft speed as described above, it also allows for electrohydraulic control to override a load sense apparatus 124 without using specialized compensation methods and/or hardware to gain stability of the pump system 118.

Figure 14:
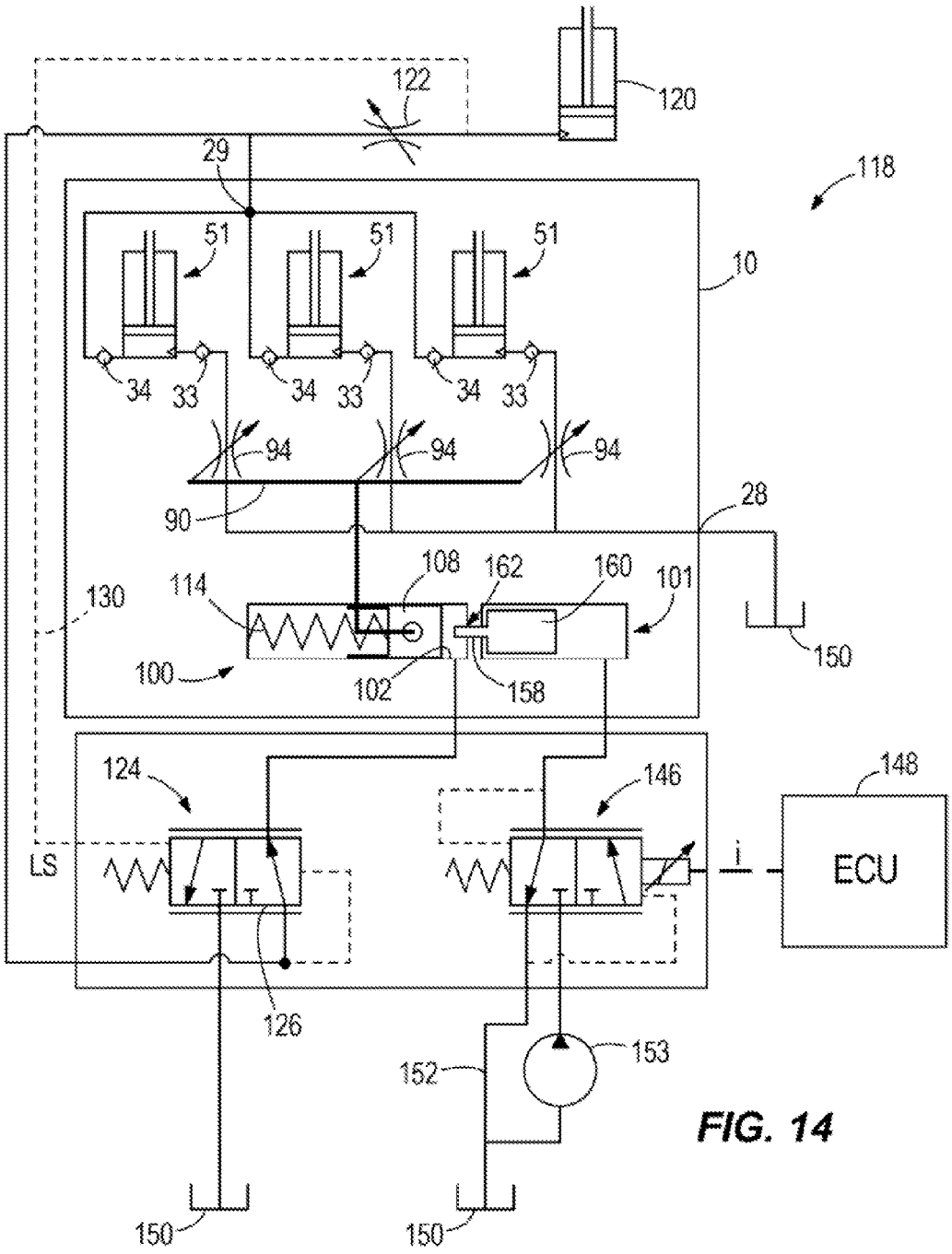
FIG. 14 shows a pump system incorporating a load sense apparatus controlling a throttle member and an electrohydraulic actuator controlling a mechanical stop.

Now with reference to FIG. 14, a further example of the pump system 118 will be described. The pump system 118 of this example has a first hydraulic actuator 100 moving a throttle member 90 to throttle flow in each inlet passage 26 in the plurality of inlet passages. The load sense apparatus 124 governs movement of the throttle member 90 by modulating a pressure in the first hydraulic actuator 100. An electrohydraulic actuator 146 governs movement of the throttle member 90 by limiting movement of the throttle member 90, as will be described further herein below. The system 118 has a mechanical stop limiting movement of the throttle member 90 and a second hydraulic actuator 101 moving the mechanical stop, wherein the electrohydraulic actuator 146 moves the mechanical stop by modulating a pressure in the second hydraulic actuator 101. In the embodiment of FIG. 14, the mechanical stop is pusher pin 158. The first and second hydraulic actuators 100, 101 are located adjacent one another such that the second hydraulic actuator 101 is configured to move the pusher pin 158 into contact with a control piston 108 in the first hydraulic actuator 100 to thereby limit movement of the throttle member 90.

FIG. 14 therefore discloses an alternative to directly overriding control by the load sense apparatus 124 with a higher pressure produced by the electrohydraulic actuator 146, as was described with reference to FIGS. 9-13. Instead, pressure produced by the load sense apparatus 124 and pressure produced by the electrohydraulic actuator 146 are isolated from one another in individual chambers (for example, hydraulic actuators 100, 101). Control by the load sense apparatus 124 is overridden by a pusher piston 160 having a pusher pin 158 controlled by pressure produced by the electrohydraulic actuator 146. In this arrangement, the pressure produced by the electrohydraulic actuator 146 is fed to a second hydraulic actuator 101 with a large area ratio. The small end of the hydraulic actuator 101 is routed with a seal 162 into the actuator bore 102 of the first hydraulic actuator 100 and acts as a hard mechanical stop, which hard mechanical stop may be a pusher pin 158. The pusher pin 158 in turn limits the flow of the pump 10 by acting as a mechanical stop past which the control piston 108 cannot go, thereby limiting the position of the throttle member 90 and thereby limiting flow. An operator may use the control circuit 148 to set a given pressure in the second hydraulic actuator 101 (corresponding to a maximum flow limit of the pump system 118), which pressure may be produced by the electrohydraulic actuator 146, to ensure that the control piston 108 can travel only a limited distance before it will hit the pusher pin 158. If the operator commands more flow than the maximum flow limit set by the control circuit 148, the pressure produced by the load sense apparatus 124 will decrease until the control piston 108 travel is eventually limited by the pusher pin 158.

It should be understood that the pump systems 118 described herein above are not limited to control by pressure produced from a load sense apparatus 124 and an electrohydraulic actuator 146, but rather can be controlled by an electrically operated actuator in place of the electrohydraulic actuator 146. In one embodiment, the electrically operated actuator is a stepper motor. In other embodiments, the electrically operated actuator is a linear solenoid, a rotary solenoid, or any other electro-mechanical actuator.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations and systems described herein may be used alone or in combination with other configurations and systems. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A pump system comprising:

a piston pump comprising a cylinder block having an inlet port, an outlet port, and a plurality of cylinders disposed therein, each cylinder in the plurality of cylinders being connected to the inlet port by a respective inlet passage in a plurality of inlet passages and to the outlet port by a respective outlet passage in a plurality of outlet passages;

a plurality of inlet valves, each inlet valve in the plurality of inlet valves located in a respective inlet passage in the plurality of inlet passages and allowing flow from the inlet port into a respective cylinder in the plurality of cylinders and restricting flow from the respective cylinder in the plurality of cylinders into the inlet port;

a plurality of pistons, each piston in the plurality of pistons being disposed in a respective cylinder in the plurality of cylinders;

a drive shaft driving the plurality of pistons within the respective cylinders; and a throttle mechanism having a throttle member independently throttling flow in each inlet passage in the plurality of inlet passages;

wherein the throttle mechanism is located between the inlet port and each inlet valve located in its respective inlet passage, such that a fluid volume between the throttle mechanism and each inlet valve can be consistently controlled due to proximity of the throttle mechanism to each inlet valve; and an electrohydraulic actuator governing movement of the throttle member.

2. The pump system of claim 1, further comprising a hydraulic actuator moving the throttle member to throttle flow in each inlet passage in the plurality of inlet passages.

3. The pump system of claim 2, wherein the electrohydraulic actuator modulates a pressure in the hydraulic actuator, thereby governing movement of the throttle member.

4. The pump system of claim 3, wherein the hydraulic actuator comprises a control piston, and wherein the pressure in the hydraulic actuator acts on the control piston to move the throttle member.

5. The pump system of claim 2, further comprising a load sense apparatus that modulates a pressure in the hydraulic actuator, thereby governing movement of the throttle member.

6. The pump system of claim 5, further comprising a pressure compensator valve referencing a pressure at the outlet port and overriding modulation of pressure in the hydraulic actuator by the load sense apparatus if pressure at the outlet port exceeds a predetermined limit.

7. The pump system of claim 5, wherein the load sense apparatus comprises a margin spool, the margin spool being biased in a first direction, being moveable in the first direction by a load sense signal, and being moveable in a second, different direction against the bias and the load sense signal by a pressure at the outlet port, thereby modulating the pressure in the hydraulic actuator.

8. The pump system of claim 1, further comprising a control circuit controlling the electrohydraulic actuator to thereby govern movement of the throttle member.

9. The pump system of claim 1, wherein the electrohydraulic actuator comprises an electric pressure control valve.

10. The pump system of claim 1, wherein the piston pump comprises a radial piston pump.

11. The pump system of claim 1, wherein the throttle member extends across the plurality of inlet passages and comprises a plurality of control apertures there through, the throttle member being moveable relative to the plurality of inlet passages to alter alignment between a respective control aperture in the plurality of control apertures and an inlet passage in the plurality of inlet passages.

12. The pump system of claim 1, further comprising a position sensor sensing a position of the throttle member.

13. The pump system of claim 1, further comprising at least one pressure sensor sensing a pressure at one or both of the inlet port and the outlet port.

14. A pump system comprising:

a piston pump comprising a cylinder block having an inlet port, an outlet port, and a plurality of cylinders disposed therein, each cylinder in the plurality of cylinders being connected to the inlet port by a respective inlet passage in a plurality of inlet passages and to the outlet port by a respective outlet passage in a plurality of outlet passages;

a plurality of pistons, each piston in the plurality of pistons being disposed in a respective cylinder in the plurality of cylinders;

a drive shaft driving the plurality of pistons within the respective cylinders; and a throttle member independently throttling flow in each inlet passage in the plurality of inlet passages;

a load sense apparatus governing movement of the throttle member based upon a load sense signal representing a pressure downstream of a control valve located downstream of the outlet port;

an electrohydraulic actuator governing movement of the throttle member based upon an electronic signal; and a hydraulic actuator moving the throttle member to throttle flow in each inlet passage in the plurality of inlet passages, wherein the load sense apparatus and the electrohydraulic actuator both govern movement of the throttle member by modulating a pressure in the hydraulic actuator;

wherein the load sense apparatus comprises a margin spool, the margin spool being biased in a first direction, being moveable in the first direction by the load sense signal, and being moveable in a second, different direction against the bias and the load sense signal by a pressure at the outlet port, thereby modulating the pressure in the hydraulic actuator.

15. The pump system of claim 14, further comprising a pressure compensator valve referencing pressure at the outlet port and overriding modulation of pressure in the hydraulic actuator by the load sense apparatus if pressure at the outlet port exceeds a predetermined limit.

16. The pump system of claim 14, wherein the hydraulic actuator comprises a control piston, and wherein the pressure in the hydraulic actuator acts on the control piston to move the throttle member.

17. The pump system of claim 14, wherein the electrohydraulic actuator and margin spool create a minimum pressure that can be supplied to the hydraulic actuator so as to set a maximum area opening position of the throttle member.

18. The pump system of claim 17, wherein the electrohydraulic actuator modulates a pressure in the margin spool by restricting flow from the margin spool to a drain connection.

19. The pump system of claim 17, wherein the pressure in the hydraulic actuator is a level of the pressure modulated by the load sense apparatus plus a bias pressure level produced by the electrohydraulic actuator.

20. The pump system of claim 14, wherein the load sense apparatus modulates the pressure in the hydraulic actuator unless a pressure produced by a flow from the electrohydraulic actuator is greater than a pressure produced by a flow from the load sense apparatus, and wherein the electrohydraulic actuator modulates the pressure in the hydraulic actuator if the pressure produced by the flow from the electrohydraulic actuator is greater than the pressure produced by the flow from the load sense apparatus.

21. The pump system of claim 20, further comprising a check valve that selectively allows flow from the electrohydraulic actuator to the hydraulic actuator when the pressure produced by the flow from the electrohydraulic actuator is greater than the pressure produced by the flow from the load sense apparatus.

22. The pump system of claim 20, further comprising a shuttle valve that selectively allows flow from one of the electrohydraulic actuator and the load sense apparatus to the hydraulic actuator;

wherein when the pressure produced by the flow from the electrohydraulic actuator is greater than the pressure produced by the flow from the load sense apparatus, the shuttle valve shuts off the flow from the load sense apparatus to the hydraulic actuator; and wherein when the pressure produced by the flow from the electrohydraulic actuator is less than the pressure produced by the flow from the load sense apparatus, the shuttle valve shuts off the flow from the electrohydraulic actuator to the hydraulic actuator.

23. The pump system of claim 14, wherein the throttle member comprises first and second throttle members, wherein the load sense apparatus governs movement of the first throttle member based upon the load sense signal, and wherein the electrohydraulic actuator governs movement of the second throttle member based upon the electronic signal.

24. The pump system of claim 23, wherein the hydraulic actuator comprises first and second hydraulic actuators, wherein the load sense apparatus governs movement of the first throttle member by modulating a pressure in the first hydraulic actuator, and wherein the electrohydraulic actuator governs movement of the second throttle member by modulating a pressure in the second hydraulic actuator.

25. The pump system of claim 23, wherein the first throttle member is located in series with the second throttle member.

26. The pump system of claim 14, wherein the hydraulic actuator comprises a first hydraulic actuator moving the throttle member to throttle flow in each inlet passage in the plurality of inlet passages, wherein the load sense apparatus governs movement of the throttle member by modulating a pressure in the first hydraulic actuator, and wherein the electrohydraulic actuator governs movement of the throttle member by limiting movement of the throttle member.

27. The pump system of claim 26, further comprising a mechanical stop limiting movement of the throttle member.

28. The pump system of claim 27, further comprising a second hydraulic actuator moving the mechanical stop, wherein the electrohydraulic actuator moves the mechanical stop by modulating a pressure in the second hydraulic actuator.

29. The pump system of claim 28, wherein the mechanical stop comprises a pusher pin, and wherein the first and second hydraulic actuators are located adjacent one another such that the second hydraulic actuator is configured to move the pusher pin into contact with a control piston in the first hydraulic actuator to thereby limit movement of the throttle member.

30. The pump system of claim 14, further comprising a control circuit providing the electronic signal to the electrohydraulic actuator.

31. The pump system of claim 14, wherein the electrohydraulic actuator comprises an electric pressure control valve.

32. The pump system of claim 14, wherein the piston pump comprises a radial piston pump.

33. The pump system of claim 14, further comprising a plurality of inlet valves, each inlet valve in the plurality of inlet valves located in a respective inlet passage in the plurality of inlet passages and allowing flow from the inlet port into a respective cylinder in the plurality of cylinders and restricting flow from the respective cylinder in the plurality of cylinders into the inlet port.

34. The pump system of claim 14, wherein the throttle member extends across the plurality of inlet passages and comprises a plurality of control apertures there through, the throttle member being moveable relative to the plurality of inlet passages to alter alignment between a respective control aperture in the plurality of control apertures and an inlet passage in the plurality of inlet passages.

35. The pump system of claim 14, further comprising at least one position sensor sensing a position of the throttle member.

36. The pump system of claim 14, further comprising at least one pressure sensor sensing a pressure at one or both of the inlet port and the outlet port.

37. A pump system comprising:

a piston pump comprising a cylinder block having an inlet port, an outlet port, and a plurality of cylinders disposed therein, each cylinder in the plurality of cylinders being connected to the inlet port by a respective inlet passage in a plurality of inlet passages and to the outlet port by a respective outlet passage in a plurality of outlet passages;

a plurality of pistons, each piston in the plurality of pistons being disposed in a respective cylinder in the plurality of cylinders;

a plurality of inlet valves, each inlet valve in the plurality of inlet valves located in a respective inlet passage in the plurality of inlet passages and allowing flow from the inlet port into a respective cylinder in the plurality of cylinders and restricting flow from the respective cylinder in the plurality of cylinders into the inlet port;

a drive shaft driving the plurality of pistons within the respective cylinders; and a throttle mechanism having a throttle member independently throttling flow in each inlet passage in the plurality of inlet passages;

wherein the throttle mechanism is located between the inlet port and each inlet valve located in its respective inlet passage, such that a fluid volume between the throttle mechanism and each inlet valve can be consistently controlled due to proximity of the throttle mechanism to each inlet valve;

a load sense apparatus governing movement of the throttle member based upon a load sense signal; and an electrically operated actuator governing movement of the throttle member based upon an electronic signal.

38. The pump system of claim 37, wherein the electrically operated actuator is an electrohydraulic actuator.

39. The pump system of claim 37, wherein the electrically operated actuator is a stepper motor.

* * * * *